US011772876B1

(12) United States Patent
Kong et al.

(10) Patent No.: US 11,772,876 B1
(45) Date of Patent: Oct. 3, 2023

(54) COMPACT GRAVITY-DRIVEN DISTRIBUTION MECHANISM FOR SPHERICAL OBJECTS

(71) Applicant: Yongming Kong, Tustin, CA (US)

(72) Inventors: Derek Chuixi Kong, Tustin, CA (US); Yongming Kong, Tustin, CA (US)

( * ) Notice: Subject to any disclaimer, the term of this patent is extended or adjusted under 35 U.S.C. 154(b) by 0 days.

(21) Appl. No.: 18/083,523

(22) Filed: Dec. 18, 2022

(51) Int. Cl.
*B65D 83/00* (2006.01)

(52) U.S. Cl.
CPC ..... *B65D 83/0083* (2013.01)

(58) Field of Classification Search
CPC .... A47G 19/24; B65D 83/0083; B65D 83/06; B65D 47/265; B65D 83/04; B65D 83/0409; B65D 83/0427; B65D 83/0481; B65D 83/049; G01F 11/282
See application file for complete search history.

(56) References Cited

U.S. PATENT DOCUMENTS 960,650 A * 6/1910 Lind ..... A47G 19/24 222/142.9
1,386,042 A * 8/1921 Wilson ..... B65D 47/265 222/555
1,471,298 A * 10/1923 Wegenaar ..... B65D 47/265 200/61.45 R
1,501,037 A * 7/1924 Peirce ..... B65D 47/265 222/555
1,558,407 A * 10/1925 Sommer ..... A45D 33/006 222/557
1,588,870 A * 6/1926 Aulbach ..... A45D 33/08 222/516
1,592,362 A * 7/1926 Hermani ..... B65D 47/265 222/516
1,769,815 A * 7/1930 Wilson ..... B65D 47/265 222/555
1,796,122 A * 3/1931 Ringenrerg ..... B65D 47/265 222/555
2,037,116 A * 4/1936 Burdick ..... B65D 47/265 222/555
2,103,520 A * 12/1937 Donnelly ..... B65D 83/0409 221/280
2,302,641 A * 11/1942 Baron ..... B65D 83/0409 221/246
2,336,882 A * 12/1943 Nyden ..... B65D 47/265 29/890.12

(Continued)

*Primary Examiner* — Donnell A Long

(57) ABSTRACT

A compact gravity-driven distribution mechanism for spherical objects comprises a spherical objects container, a deflector inside the container, and a spherical objects regulator with a rotary plate attached at the bottom. Spherical objects are pre-loaded or dynamically flow into the spherical objects container and the deflector in the container guides spherical objects into the spherical objects regulator underneath the container. The spherical objects regulator regulates the spherical objects into three chambers where the spherical objects are ready for discharge. Spherical objects flow out of the spherical objects regulator in three streams. The rotary plate can be rotated to shut or open the channel of spherical objects flow. Spherical object flow is driven solely by gravity, which makes the mechanism energy efficient. The compound structure of this mechanism can be small and compact, making it easy to be deployed.

16 Claims, 2 Drawing Sheets

(56) References Cited

U.S. PATENT DOCUMENTS 2,580,096 A * 12/1951 Holt ..... B65D 83/0409 221/246
2,729,366 A * 1/1956 Chadwick ..... B65D 83/0409 222/362
3,045,871 A * 7/1962 Henrickson ..... B65D 83/06 220/604
3,058,630 A * 10/1962 Abt ..... B26D 1/00 222/548
3,527,383 A * 9/1970 Borsum ..... B65D 83/0409 221/122
3,638,830 A * 2/1972 Belokin, Jr. ..... B65D 83/0409 221/265
3,991,908 A * 11/1976 Thomas ..... B65D 83/0409 221/265
4,141,558 A * 2/1979 Hoffman ..... A63B 57/0006 473/132
4,154,365 A * 5/1979 Lorca ..... B65D 83/0409 221/302
5,111,976 A * 5/1992 Ban ..... G03G 15/087 222/DIG. 1
5,673,812 A * 10/1997 Nelson ..... A63B 47/002 221/265
5,791,515 A * 8/1998 Khan ..... B65D 83/0409 221/265
5,901,886 A * 5/1999 Grindstaff ..... A01K 5/0275 222/548
6,470,921 B1 * 10/2002 McGregor ..... B65B 1/12 222/413
2005/0098576 A1 * 5/2005 Fenton ..... G07F 11/163 221/276
2008/0087690 A1 * 4/2008 Parve ..... B65D 47/265 222/545
2010/0276441 A1 * 11/2010 Pordy ..... A47G 19/24 222/565
2011/0215116 A1 * 9/2011 Fuller ..... B65D 47/0847 222/548
2022/0113174 A1 * 4/2022 Kepler ..... G01F 11/46
2023/0056014 A1 * 2/2023 Dilworth ..... B65D 83/0083

* cited by examiner

COMPACT GRAVITY-DRIVEN DISTRIBUTION MECHANISM FOR SPHERICAL OBJECTS

BACKGROUND OF THE INVENTION

In our daily lives, many items are shaped like spheres, like metal balls in ball bearings, golf balls, tennis balls, marbles, some medicinal pills, etc. Generally, when distributing such items in the manufacturing process or in packaging, a large area is used to scatter spherical objects in order to avoid congestion during distribution. Then, electrical/mechanical power is consumed to move the spherical objects around. For instance, chained slot buckets (or similar structures) are often used. Combined with an inclined slope, they move through piles of spherical objects, catching a certain number of said objects in a row in each bucket. When a bucket moves to the top of the slope, it dumps the spherical objects into a passage, where the spherical objects line up and roll down the passage one by one. There are two major disadvantages in such distribution mechanism. First, it consumes a lot of energy to drive the whole mechanism with the load of spherical objects from one place to another. Secondly, the mechanism requires a large space to move the objects around for distribution. An alternative method to distribute spherical objects is to pre-arrange the objects in a queue and release the objects one by one. However, this method is time-consuming and cannot be easily automated. The solution to be presented is a spherical object distribution mechanism that utilizes gravity to drive spherical objects flow in a compact space. This invention is energy efficient, compact, and can easily be automated.

SUMMARY OF THE INVENTION

A compact gravity-driven distribution mechanism for spherical objects provides an efficient way to distribute spherical objects in streams through a round structure that doesn't take much space. It comprises of a spherical objects container, a deflector, a spherical objects regulator, and a rotary plate. Being guided by the deflector, spherical objects in the spherical objects container flow downwards into the spherical objects regulator. They then move into three chambers of the spherical objects regulator. Spherical objects in the chambers are finally discharged from the mechanism through three discharge holes at the bottom of the three chambers. The mechanism doesn't consume energy to drive the flow of spherical objects because the movement of the spherical objects is driven solely by gravity. It is a round, compact structure that is designed to help spherical objects move smoothly without congestion in their passage from the spherical objects container to the chambers for discharge. The only place where external power is needed is the rotary plate that rotates to open or shut discharge holes to control the release of spherical objects.

DETAILED DESCRIPTION OF THE INVENTION

Figure 1:
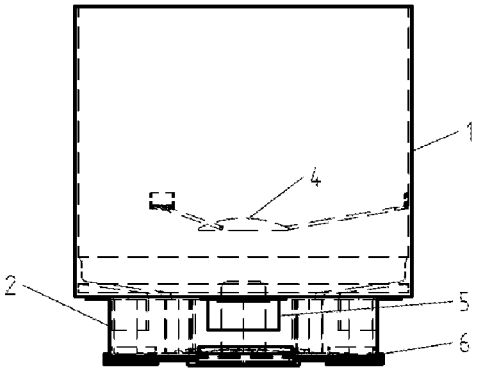
FIG. 1 is a front view of a compact gravity-driven distribution mechanism for spherical objects.
Figure 2:
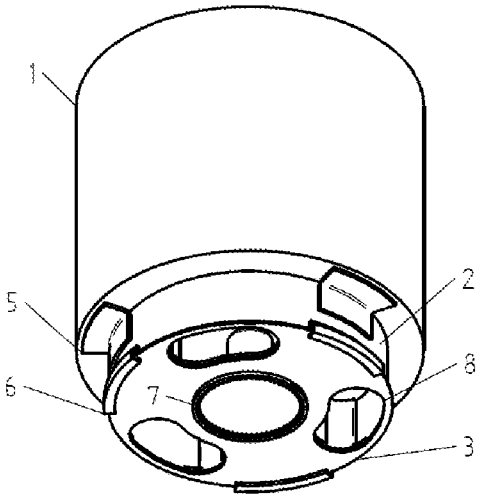
FIG. 2 is a perspective view from the bottom of a compact gravity-driven distribution mechanism for spherical objects.
Figure 4:
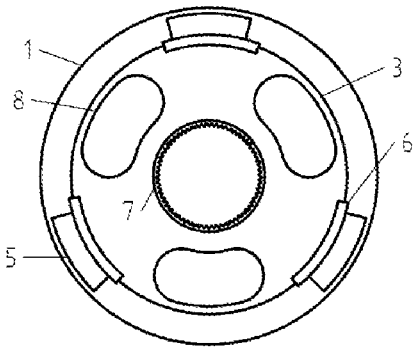
FIG. 4 is a bottom view of a compact gravity-driven distribution mechanism for spherical objects.

Referring to FIG. 1 and FIG. 2, one embodiment of a compact gravity-driven distribution mechanism for spherical objects is generally shown as including at least a spherical objects container 1, a spherical objects regulator 2, a rotary plate 3, and a deflector 4. The spherical objects container 1 is connected to the spherical objects regulator 2 by three brackets 5. The rotary plate 3 is attached to the bottom of the spherical objects regulator 2 by three circular U section rails 6, as shown in FIG. 2 and FIG. 4.

Figure 5:
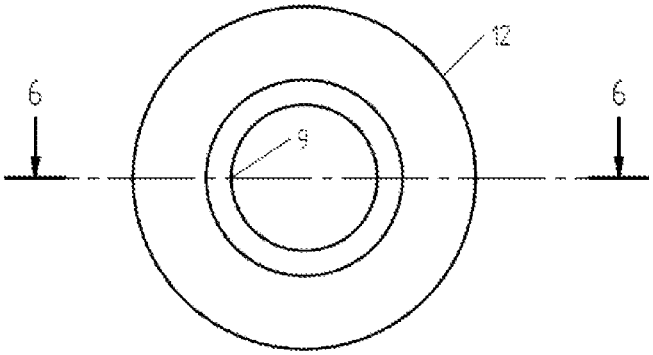
FIG. 5 is a bottom view of a spherical objects container.
Figure 6:
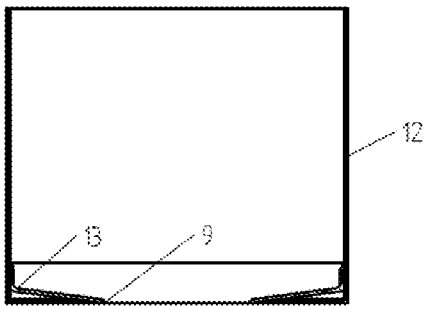
FIG. 6 is a section view of a spherical objects container.

The spherical objects container 1 stores and also receives spherical objects. As shown in FIG. 5 and FIG. 6, the spherical objects container 1 comprises of an outer cylinder body 12 and a shallow inverted cone-shaped ring 13. At the center of the shallow inverted cone-shaped ring 13 is a dropping hole 9, where spherical objects flow into the spherical objects regulator 2. The shallow inverted cone-shaped ring 13 forms a slope stretching from the circular wall of the outer cylinder body 12 towards the dropping hole 9, which helps spherical objects at the bottom of the spherical objects container 1 flow towards the dropping hole 9.

Figure 3:
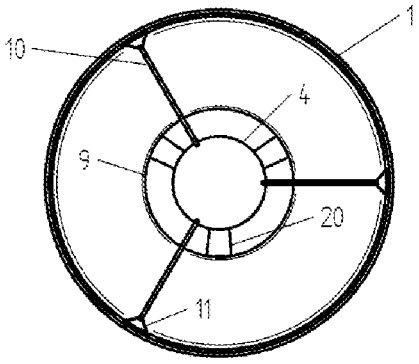
FIG. 3 is a top view of a compact gravity-driven distribution mechanism for spherical objects.

The deflector 4 is a round cap with its top being part of a sphere and its bottom being flat and parallel to the ground, and its circular edge is blended to avoid sharp corner. The deflector 4 is installed inside the spherical objects container 1 to guide the flow of spherical objects and avoid the congestion of spherical objects directly above the dropping hole 9 of the spherical objects container 1, as shown in FIG. 1 and FIG. 3. The deflector 4 is connected to the outer cylinder body 12 of the spherical objects container 1 by three rods 10. The three rods 10 are attached to three brackets 11, as shown in FIG. 1 and FIG. 3. The deflector 4 eliminates the pressure from spherical objects above the dropping hole 9 to the spherical objects entering the dropping hole 9, which ensures spherical objects flow into the dropping hole 9 from surrounding areas of the dropping hole 9 with no chance to congest at the dropping hole 9.

Figure 7:
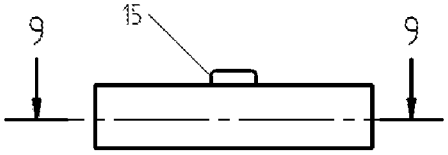
FIG. 7 is a front view of a spherical objects regulator.
Figure 8:
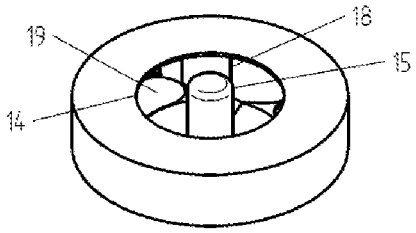
FIG. 8 is a perspective view of a spherical objects regulator.
Figure 9:
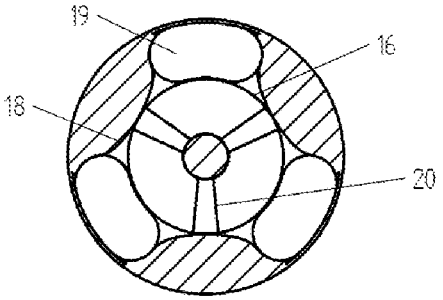
FIG. 9 is a section view of a spherical objects regulator.
Figure 10:
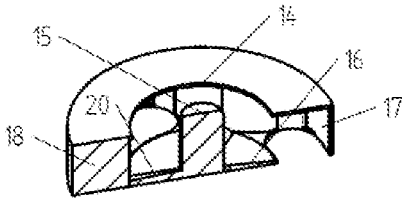
FIG. 10 is a break-out view of a spherical objects regulator.
Figure 11:
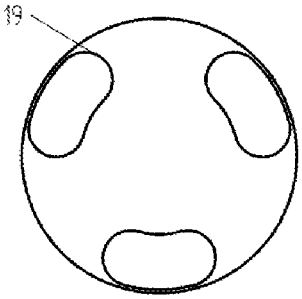
FIG. 11 is a bottom view of a spherical objects regulator.

The spherical objects regulator 2 in FIG. 7 and FIG. 8 is the place where spherical objects get regulated to specific locations for distribution. As shown in FIG. 8 and FIG. 10, an intake hole 14 is at the center of the top of the spherical objects regulator 2, through which spherical objects flow into the spherical objects regulator 2 from the spherical objects container 3. The intake hole 14 has the same diameter as the dropping hole 9, and it is placed concentrically with the dropping hole 9 and right below the dropping hole 9. A guiding pole 15 sits at the bottom of the spherical objects regulator 2. It is concentric with the intake hole 14 and sticks out of the intake hole 14, helping to guide the spherical objects being pushed into the intake hole 14 by gravity. At the bottom of the spherical objects regulator 2 sits a cone disc 16 concentric with the guiding pole 15. The guiding pole 15 passes through the cone disc 16. Once spherical objects flow into the spherical objects regulator 2, the cone disc 16 helps them move from center of the spherical objects regulator 2 towards its outskirts. On the outskirts of the spherical objects regulator 2 are three chambers 17, they are separated by three guiding islands 18. At the bottom of the three chambers 17 are three discharge holes 19, where two spherical objects can easily pass through shoulder to shoulder at the same time. The three guiding islands 18 are rounded with smooth faces, and they help guide spherical objects into the three chambers 17, where said spherical objects are ready to be released. To further assist spherical objects in moving towards the three chambers 17, three bumper shape destabilizers 20 are installed on top of the cone disc 16, each of them passes through the symmetric plane of each of the three guiding islands 18.

The rotary plate 3 is designed to control the release of spherical objects from the three chambers 17. It has three release holes 8, each of them has the same shape as each of the discharge holes 19. The three release holes 8 can perfectly overlap the discharge holes 19. A ring gear 7 is attached to the bottom of the rotary plate 3 and is concentric to the rotary plate 3. An external gear system can be paired with the ring gear 7, being driven either manually or by a low capacity motor. When the three release holes 8 are aligned to the discharge holes 19 of the spherical objects regulator 2 as shown in FIG. 2, spherical objects will be released from the three chambers 17, and spherical objects keep moving into the three chambers 17 and then get released. When the rotary plate 3 is rotated to a position where the three discharge holes 19 of the spherical objects regulator 2 are completely covered by the rotary plate 3, the flow of spherical objects is halted.

The invention claimed is:

1. A spherical objects regulator comprising:

a circular box with a top plate, a bottom plate and a circular wall;

an intake hole located at center of said top plate;

a guiding pole installed at center of said bottom plate;

three discharge holes that spread evenly along the circumference of said bottom plate touching said circular wall;

three guiding islands that are placed between said discharge holes in such a way that each island is adjacent to two discharge holes;

a cone disc sitting on said bottom plate with its outer edge touching said guiding islands and inner edge surrounding the guiding pole, with its height gradually decreasing from inner edge to outer edge;

three bumper shape destabilizers installed on the top of said cone disc passing through symmetric planes of each guiding islands respectively;

a rotary plate that is attached underneath said circular box, and it shuts down or opens up the flow of spherical objects.

2. A spherical objects regulator as in claim 1, wherein said intake hole has a diameter slightly larger than three times of spherical object diameter.

3. A spherical objects regulator as in claim 1, wherein said guiding pole has a circular section with a diameter smaller than spherical object diameter and said guiding pole passes through said intake hole sticking out of said circular box by less than half of a spherical object's diameter.

4. A spherical objects regulator as in claim 1, wherein said discharge holes are in circular slot shape and their outer circular edges merge into said circular wall, each of said discharge holes allows two spherical objects freely pass through shoulder to shoulder.

5. A spherical objects regulator as in claim 1, wherein said three guiding islands have the same shape and size and are evenly spread along the circumference of said circular box, each island is symmetric about a plane passing through center axis of said circular box.

6. A spherical objects regulator as in claim 1, wherein said three guiding islands don't overlap said discharge holes.

7. A spherical objects regulator as in claim 1, further comprising three chambers formed by said three guiding islands, said top plate, and said circular wall, with one discharge hole being located at the bottom of each chamber.

8. A spherical objects regulator as in claim 1, further comprising a circular passage formed by said three guiding islands and said guiding pole, which is wider than a spherical object's diameter.

9. A spherical objects regulator as in claim 1, wherein said three bumper shape destabilizers sit on top of said cone disc stretching from said guiding islands to said guiding pole, and each destabilizer's symmetric plane is coplanar to the symmetric plane of one of the said three guiding islands.

10. A spherical objects regulator as in claim 1, wherein said rotary plate has three release holes exactly matching the shape and size of said discharge holes, it rotates around the center axis of said circular box to make said three release holes perfectly overlap said three discharge holes.

11. A compact gravity-driven distribution mechanism for spherical objects comprising:

a spherical objects container that takes and stores spherical objects;

a deflector;

a spherical objects regulator as in claim 1.

12. A compact gravity-driven distribution mechanism for spherical objects as in claim 11, wherein said spherical objects container is formed by a circular wall, a bottom ring and a shallow inverted cone-shaped ring.

13. A compact gravity-driven distribution mechanism for spherical objects as in claim 12, wherein said shallow inverted cone-shaped ring sits on top of said bottom ring and descends from said circular wall towards the center axis of said spherical objects container, and the inner edge of said shallow inverted cone-shaped ring forms a hole.

14. A compact gravity-driven distribution mechanism for spherical objects as in claim 11, wherein said deflector has a shape of a sphere, a bottom of said deflector is flat and made parallel to the ground, a circular edge of said deflector is rounded to prevent a sharp edge, and said deflector is connected to said circular wall of said spherical objects container by three rods.

15. A compact gravity-driven distribution mechanism for spherical objects as in claim 11, wherein said deflector is installed in the center of said spherical objects container with a distance of less than double the spherical object diameter from bottom of said deflector to the bottom of said spherical objects container.

16. A compact gravity-driven distribution mechanism for spherical objects as in claim 11, wherein said spherical objects container sits right on top of said spherical objects regulator.

* * * * *